US005594958A

United States Patent [19]

Nguyen

[11] Patent Number: 5,594,958

[45] Date of Patent: Jan. 21, 1997

[54] HANDS-OFF TOILET SEAT LIFTING APPARATUS

[76] Inventor: Lanh N. Nguyen, 14401 Peltier Dr. #101, New Orleans, La. 70129

[21] Appl. No.: 502,478

[22] Filed: Jul. 14, 1995

[51] Int. Cl.[6] ..... A47K 13/10

[52] U.S. Cl. ..... 4/246.5

[58] Field of Search ..... 4/246.1, 246.3, 4/246.4, 246.5

[56] References Cited

U.S. PATENT DOCUMENTS

| | | | |
|---|---|---|---|
| 69,661 | 10/1867 | Hanniman | 4/246.3 |
| 1,863,295 | 6/1932 | Bukovitz | 4/246.5 |
| 2,410,854 | 11/1946 | Zulkoski | 4/246.5 |
| 2,954,565 | 10/1960 | Miller | 4/246.5 X |
| 5,339,468 | 8/1994 | Lin | 4/246.5 |
| 5,488,743 | 2/1996 | Alfonso | 4/246.1 |

FOREIGN PATENT DOCUMENTS

| | | | |
|---|---|---|---|
| 0072213 | 3/1960 | France | 4/246.5 |

*Primary Examiner*—Robert M. Fetsuga

[57] ABSTRACT

A hands-off toilet seat lifting apparatus comprised of a mounting bracket adapted for removable securement around a base of an existing toilet. The mounting bracket has a securement block secured to an outer surface thereof. The device contains a first foot pedal having a rod extending outwardly therefrom. The rod has an end portion pivotally coupled to an intermediate portion of an arm. A stop mechanism is coupled around the pivotally coupled rod and arm. The arm has a first end and a second end. The first end is pivotally coupled to an outer surface of the securement block of the mounting bracket. The second end of the arm has an adjustable shaft extending upwardly therefrom. The adjustable shaft has an end portion secured to a toilet cover. The first foot pedal has a spring secured to a bottom surface thereof. The first end of the arm has a spring secured to a bottom surface thereof.

3 Claims, 3 Drawing Sheets

102
104
44
72
106
80
84
5
12
22
32
42
28
46
26
100
70
2

HANDS-OFF TOILET SEAT LIFTING APPARATUS

BACKGROUND OF THE INVENTION

1. Field of the Invention

The present invention relates to a hands-off toilet seat lifting apparatus and, more particularly, pertains to raising and lowering both a toilet seat and toilet cover without using hands with a hands-off toilet seat lifting apparatus.

2. Description of the Prior Art

The use of lifting devices is known in the prior art. More specifically, lifting devices heretofore devised and utilized for the purpose of lifting objects to an upright position are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,975,988 to Won discloses a foot-operated toilet seat lifting and lowering mechanism.

U.S. Pat. No. 4,649,576 to Lillie discloses a foot-actuated toilet seat lifting device.

U.S. Pat. No. 5,327,589 to Rice discloses a toilet seat raising mechanism.

U.S. Pat. No. 5,237,708 to Zamoyski discloses a foot-actuated toilet seat lifting, anti-slamming, and reseating device.

Lastly, U.S. Pat. No. 5,323,496 to Blair discloses a toilet seat lifting apparatus.

In this respect, the hands-off toilet seat lifting apparatus according to the present invention substantially departs from the conventional concepts and designs of the prior art, and in so doing provides an apparatus primarily developed for the purpose of raising and lowering both a toilet seat and toilet cover without using hands with a hands-off toilet seat lifting apparatus.

Therefore, it can be appreciated that there exists a continuing need for a new and improved hands-off toilet seat lifting apparatus which can be used for raising and lowering both a toilet seat and toilet cover without using hands with a hands-off toilet seat lifting apparatus. In this regard, the present invention substantially fulfills this need.

SUMMARY OF THE INVENTION

In view of the foregoing disadvantages inherent in the known types of lifting devices now present in the prior art, the present invention provides an improved hands-off toilet seat lifting apparatus. As such, the general purpose of the present invention, which will be described subsequently in greater detail, is to provide a new and improved hands-off toilet seat lifting apparatus and method which has all the advantages of the prior art and none of the disadvantages.

To attain this, the present invention essentially comprises a hands-off toilet seat lifting apparatus for raising and lowering both a toilet seat and toilet cover without using hands generally comprised of a mounting bracket adapted for removable securement around a base of an existing toilet. The mounting bracket consists of a front brace, a rear brace, a right brace, and a left brace. The left brace has a securement block secured to an outer surface thereof adjacent to the rear braces. The device contains a first foot pedal having a rod extending outwardly therefrom. The rod has an end portion pivotally coupled to an intermediate portion of an arm. A stop mechanism is coupled around the pivotally coupled rod and arm. The arm has a first end and a second end. The first end is pivotally coupled to an outer surface of the securement block of the mounting bracket. The second end of the arm has an adjustable shaft extending upwardly therefrom. The adjustable shaft has an end portion secured to a toilet cover. The first foot pedal has a spring secured to a bottom surface thereof. The first end of the arm has a spring secured to a bottom surface thereof. The device contains a second foot pedal having a rod extending outwardly therefrom. The rod has an end portion pivotally coupled to an intermediate portion of an arm. A stop mechanism is coupled around the pivotally coupled rod and arm. The arm has a first end and a second end. The first end is pivotally coupled to an inner surface of the securement block of the mounting bracket. The second end of the arm has an adjustable shaft extending upwardly therefrom. The adjustable shaft has an end portion secured to a toilet seat. The second foot pedal has a spring secured to a bottom surface thereof. The first end of the arm has a spring secured to a bottom surface thereof. A spring stop mechanism is secured to an upper surface of the securement block. The spring stop mechanism prevents the first foot pedal and the second foot pedal from extending too far. A plastic cover is adapted for securement over the first foot pedal and the second foot pedal.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hands-off toilet seat lifting apparatus which has all the advantages of the prior art lifting devices and none of the disadvantages.

It is another object of the present invention to provide a new and improved hands-off toilet seat lifting apparatus which may be easily and efficiently manufactured and marketed.

It is a further object of the present invention to provide a new and improved hands-off toilet seat lifting apparatus which is of a durable and reliable construction.

An even further object of the present invention is to provide a new and improved hands-off toilet seat lifting apparatus which is susceptible of a low cost of manufacture with regard to both materials and labor, and which accordingly is then susceptible of low prices of sale to the consuming public, thereby making such lifting device economically available to the buying public.

Still yet another object of the present invention is to provide a new and improved hands-off toilet seat lifting apparatus which provides in the apparatuses and methods of the prior art some of the advantages thereof, while simultaneously overcoming some of the disadvantages normally associated therewith.

Even still another object of the present invention is to raise and lower both a toilet seat and toilet cover without using hands with a hands-off toilet seat lifting apparatus.

Lastly, it is an object of the present invention to provide a hands-off toilet seat lifting apparatus comprised of a mounting bracket adapted for removable securement around a base of an existing toilet. The mounting bracket has a securement block secured to an outer surface thereof. The device contains a first foot pedal having a rod extending outwardly therefrom. The rod has an end portion pivotally coupled to an intermediate portion of an arm. A stop mechanism is coupled around the pivotally coupled rod and arm. The arm has a first end and a second end. The first end is pivotally coupled to an outer surface of the securement block of the mounting bracket. The second end of the arm has an adjustable shaft extending upwardly therefrom. The adjustable shaft has an end portion secured to a toilet cover. The first foot pedal has a spring mounted to a bottom surface thereof. The first end of the arm has a spring secured to a bottom surface thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figures 1, 2:
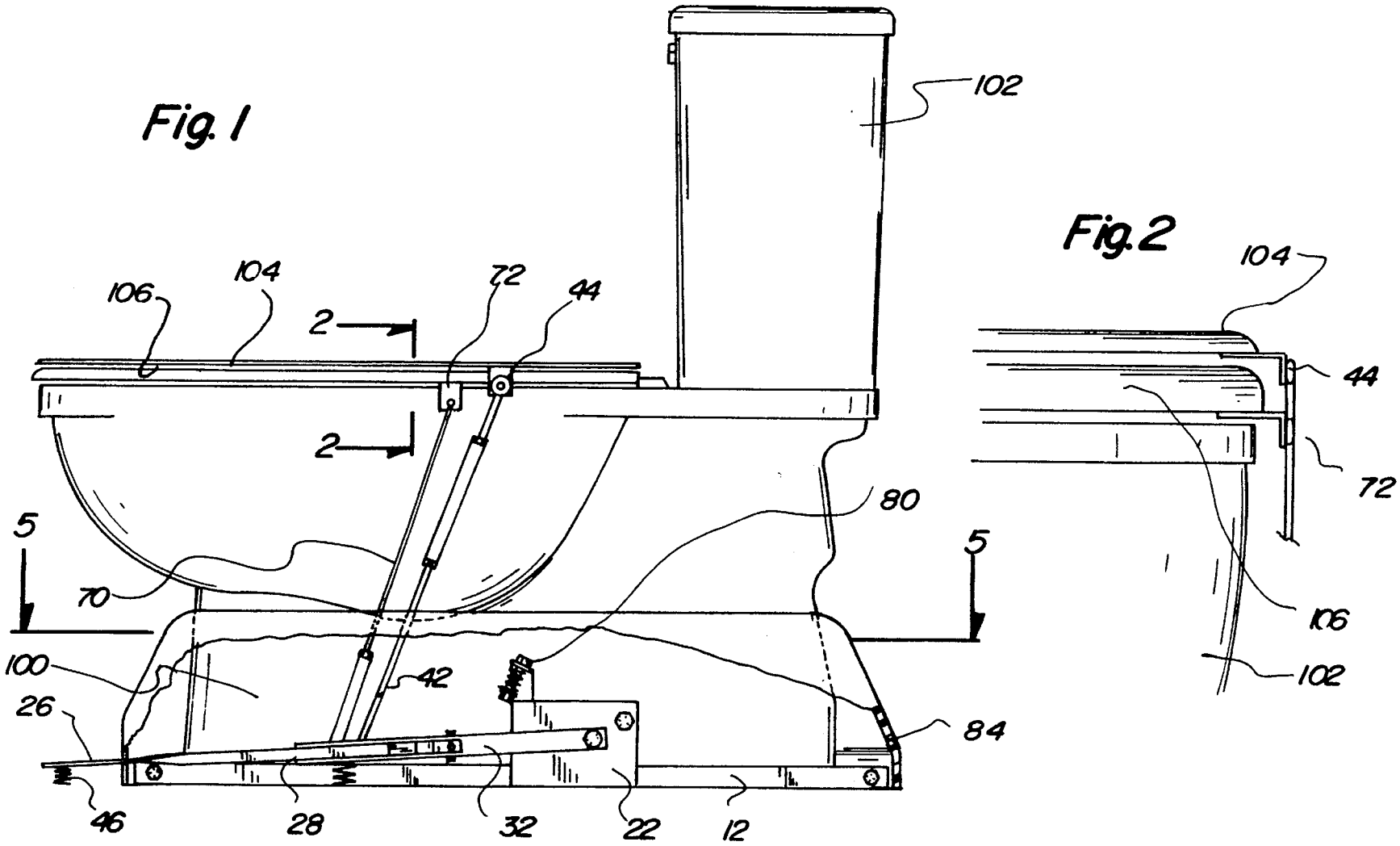
FIG. 1 is a perspective illustration of the preferred embodiment of the hands-off toilet seat lifting apparatus constructed in accordance with the principles of the present invention.
FIG. 2 is a fragmentary view as taken along line 2—2 of FIG. 1.
Figure 4:
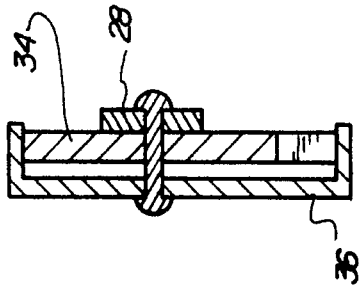
FIG. 4 is a cross-sectional view as taken along line 4—4 of FIG. 3.
Figure 3:
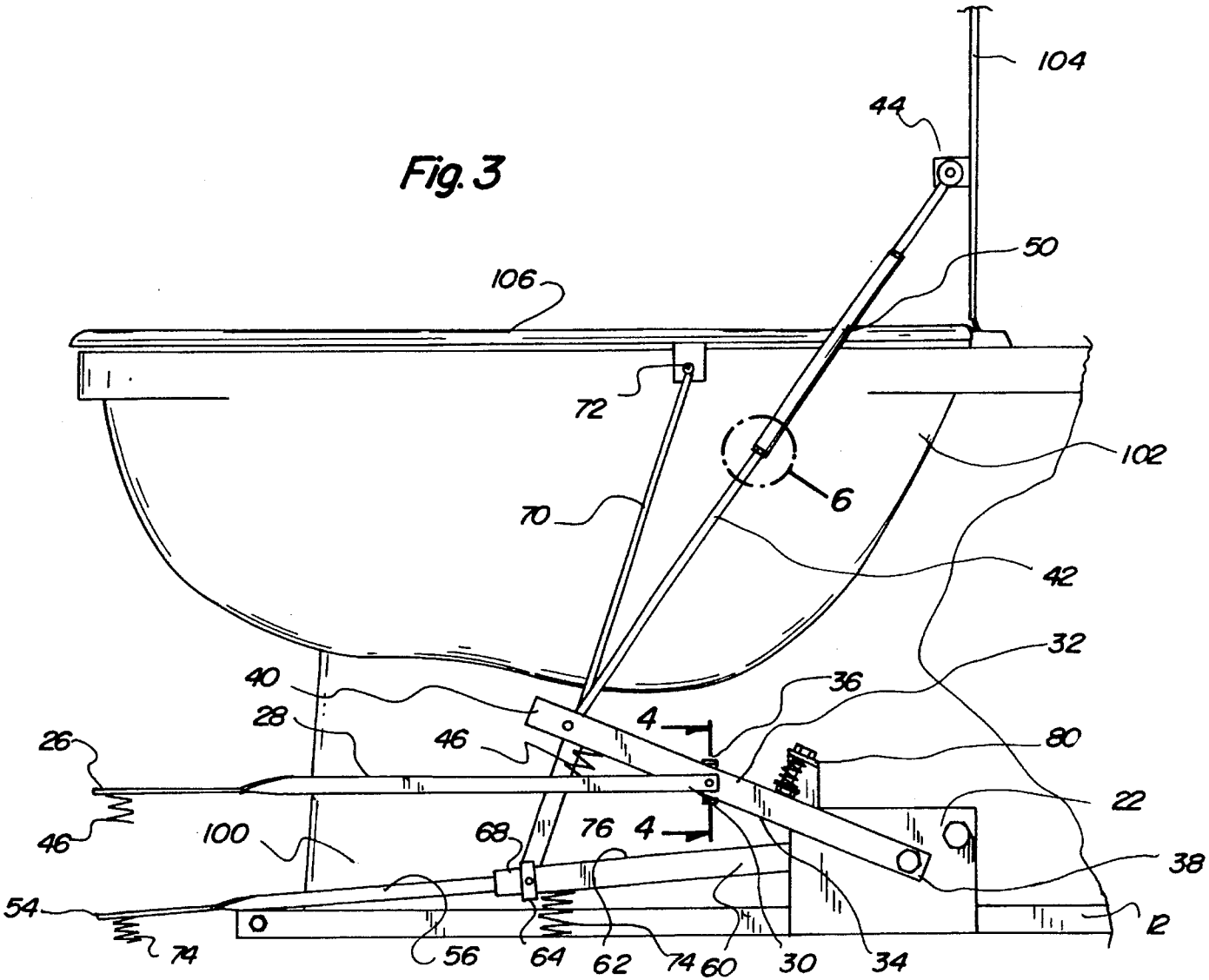
FIG. 3 is a side elevational view of the present invention.
Figure 6:
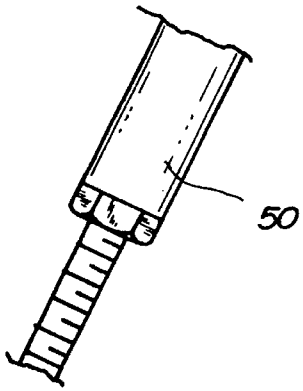
FIG. 6 is a fragmentary view of the adjustment rod of the present invention.
Figure 5:
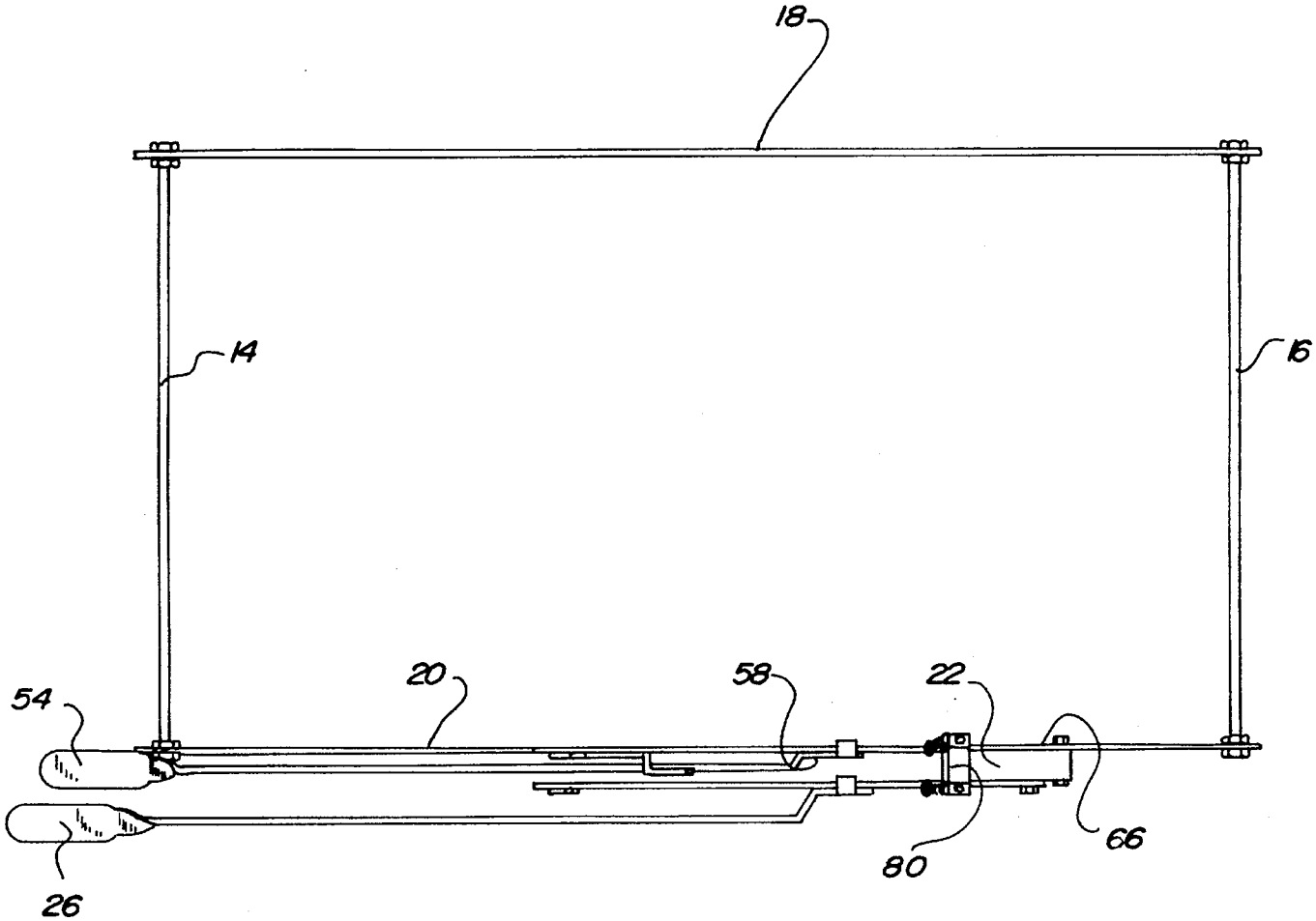
FIG. 5 is a plan view as taken along line 5—5 of FIG. 1.

With reference now to the drawings, and in particular to FIG. 1 thereof, the preferred embodiment of the new and improved hands-off toilet seat lifting apparatus embodying the principles and concepts of the present invention and generally designated by the reference numeral 10 will be described.

Specifically, it will be noted in the various Figures that the device 10 relates to a new and improved hands-off toilet seat lifting apparatus for raising and lowering both a toilet seat and toilet cover without using hands. In its broadest context, the device 10 consists of a mounting bracket, a first foot pedal, a second foot pedal, a spring stop mechanism, and a plastic cover. Such components are individually configured and correlated with respect to each other so as to attain the desired objective.

The first component of the device 10 is a mounting bracket 12. The mounting bracket 12 is adapted for removable securement around a base 100 of an existing toilet 102. The mounting bracket 12 consists of a front brace 14, a rear brace 16, a right brace 18, and a left brace 20. The left brace 20 has a securement block 22 secured to an outer surface thereof adjacent to the rear brace 16. The mounting bracket is easily assembled around the base 100 by nuts and blots. When the mounting bracket 12 is assembled its configuration is rectangular. The mounting bracket 12 can be adjusted to fit around the base of any toilet.

The second component of the device 10 is a first foot pedal 26. The first foot pedal 26 has a rod 28 extending outwardly therefrom. The rod 28 has an end portion 30 pivotally coupled to an intermediate portion 32 of an arm 34. A stop mechanism 36 is coupled around the pivotally coupled rod 28 and arm 34. The stop mechanism 36 is a U-shaped bracket that prevents the rod 28 from pivoting too far relative to the arm 34. The arm 34 has a first end 38 and a second end 40. The first end 38 is pivotally coupled to an outer surface of the securement block 22 of the mounting bracket 12. The second end 40 of the arm 34 has an adjustable shaft 42 extending upwardly therefrom. The adjustable shaft 42 has an end portion 44 secured to a toilet cover 104. The adjustable shaft 42 incorporates turnbuckles 50 to adjust the height of the shaft relative to the height of the toilet 102. The first foot pedal 26 has a spring 46 secured to a bottom surface thereof. The second end 40 of the arm 34 has a spring 46 secured to a bottom surface thereof. The springs 46 serve to prevent wear and tear caused by the first foot pedal 26 made when contacting a bathroom floor. The first foot pedal 26 is covered with a vinyl non-slip surface. A user simply places their foot underneath the first foot pedal 26 and raises their foot which will cause the pedal 26 to raise thus causing the rod 28 and the arm 34 and the adjustable shaft 42 to raise thereby raising the toilet cover 104.

The third component of the device 10 is a second foot pedal 54. The second foot pedal 54 has a rod 56 extending outwardly therefrom. The rod 56 has an end potion 58 pivotally coupled to an intermediate portion 60 of an arm 62. A stop mechanism 64 is coupled around the pivotally coupled rod 56 and arm 62. The arm 62 has a first end 66 and a second end 68. The first end 66 is pivotally coupled to an inner surface of the securement block 22 of the mounting bracket 12. The second end 68 of the arm 62 has an adjustable shaft 70 extending upwardly therefrom. The adjustable shaft 70 has an end portion 72 secured to a toilet seat 106. The adjustable shaft 70 incorporates turnbuckles 76 to adjust the height of the shaft 70 relative to the height of the toilet 102. The second foot pedal 54 has a spring 74 secured to a bottom surface thereof. The first end 66 of the arm 62 has a spring 74 secured to a bottom surface thereof. The springs 74 serve to prevent wear and tear caused by the second foot pedal 54 made when contacting the bathroom floor. The second foot pedal 54 is covered with a vinyl non-slip surface. A user simply places their foot underneath the second foot pedal 54 and raises their foot which will cause the pedal 54 to raise thus causing the rod 56 and the arm 62 and the adjustable shaft 70 to raise thereby raising the toilet seat 106. The user then simply presses down on the second foot pedal 54 to reverse the process thereby lowering the toilet seat 106.

The fourth component of the device 10 is a spring stop mechanism 80. The spring stop mechanism 80 is secured to an upper surface of the securement block 22. The spring stop mechanism 80 prevents the first foot pedal 26 and the second foot pedal 54 from extending too far.

The final component of the device 10 is a plastic cover 84. The plastic cover 84 is adapted for securement over the first foot pedal 26 and the second foot pedal 54. The plastic cover 84 is designed to protect the other components of the device 10 as well as present an overall neat appearance of the device 10.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A hands-free toilet seat lifting apparatus for raising and lowering a toilet cover of an existing toilet without using hands comprising, in combination:

a mounting bracket adapted for removable securement around a base of the existing toilet, the mounting bracket having a securement block secured to an outer surface thereof;

a first foot pedal having a rod extending outwardly therefrom, the rod having an end portion pivotally coupled to an intermediate portion of an arm, a stop mechanism coupled around the pivotally coupled rod and arm, the arm having a first end and a second end, the first end pivotally coupled to an outer surface of the securement block of the mounting bracket, the second end of the arm having an adjustable shaft extending upwardly therefrom, the adjustable shaft having an end portion securable to the toilet cover of the existing toilet, the first foot pedal having a spring secured to a bottom surface thereof, the first end of the arm having a spring secured to a bottom surface thereof;

a second foot pedal having a rod extending outwardly therefrom, the rod having an end portion pivotally coupled to an intermediate portion of an arm, a stop mechanism coupled around the pivotally coupled rod and arm, the arm having a first end and a second end, the first end pivotally coupled to an outer surface of the securement block of the mounting bracket, the second end of the arm having an adjustable shaft extending upwardly therefrom, the adjustable shaft having an end portion securable to a toilet seat of the existing toilet, the second foot pedal having a spring secured to a bottom surface thereof, the first end of the arm having a spring secured to a bottom surface thereof;

a spring stop mechanism secured to an upper surface of the securement block, the spring stop mechanism preventing the first foot pedal and the second foot pedal from extending too far.

2. The apparatus as described in claim 1 and further including a plastic cover adapted for securement over the first foot pedal and the second foot pedal.

3. A hands-free toilet seat lifting apparatus for raising and lowering both an existing toilet seat and an existing toilet cover without using hands comprising, in combination:

a mounting bracket adapted for removable securement around a base of an existing toilet, the mounting bracket consisting of a front brace, a rear brace, a right brace, and a left brace, the left brace having a securement block secured to an outer surface thereof adjacent to the rear braces;

a first foot pedal having a rod extending outwardly therefrom, the rod having an end portion pivotally coupled to an intermediate portion of an arm, a stop mechanism coupled around the pivotally coupled rod and arm, the arm having a first end and a second end, the first end pivotally coupled to an outer surface of the securement block of the mounting bracket, the second end of the arm having an adjustable shaft extending upwardly therefrom, the adjustable shaft having an end portion securable to the existing toilet cover, the first foot pedal having a spring secured to a bottom surface thereof, the first end of the arm having a spring secured to a bottom surface thereof;

a second foot pedal having a rod extending outwardly therefrom, the rod having an end portion pivotally coupled to an intermediate portion of an arm, a stop mechanism coupled around the pivotally coupled rod and arm, the arm having a first end and a second end, the first end pivotally coupled to an outer surface of the securement block of the mounting bracket, the second end of the arm having an adjustable shaft extending upwardly therefrom, the adjustable shaft having an end portion securable to the existing toilet seat, the second foot pedal having a spring secured to a bottom surface thereof, the first end of the arm having a spring secured to a bottom surface thereof;

a spring stop mechanism secured to an upper surface of the securement block, the spring stop mechanism preventing the first foot pedal and the second foot pedal from extending too far;

a plastic cover adapted for securement over the first foot pedal and the second foot pedal.

* * * * *